US008783709B1

(12) United States Patent
Westermann et al.

(10) Patent No.: US 8,783,709 B1
(45) Date of Patent: Jul. 22, 2014

(54) PERSON TRANSPORTING APPARATUS AND METHOD

(71) Applicants: Karl H. Westermann, Round Rock, TX (US); Mary Kay Schitton, Round Rock, TX (US)

(72) Inventors: Karl H. Westermann, Round Rock, TX (US); Mary Kay Schitton, Round Rock, TX (US)

( * ) Notice: Subject to any disclaimer, the term of this patent is extended or adjusted under 35 U.S.C. 154(b) by 0 days.

(21) Appl. No.: 14/022,914

(22) Filed: Sep. 10, 2013

(51) Int. Cl.
*A61G 5/00* (2006.01)
*A61G 1/017* (2006.01)

(52) U.S. Cl.
CPC . *A61G 5/00* (2013.01); *A61G 1/017* (2013.01)
USPC ..... 280/650; 280/657; 280/304.5; 5/86.1; 5/83.1

(58) Field of Classification Search
CPC ..... A61G 5/00; A61G 2005/08; A61G 2005/1091; A61G 1/017
USPC ..... 280/250.1, 638, 640, 643, 647, 648, 280/650, 657, 290, 304.1, 304.5, 47.38, 280/47.4, 47.41; 297/DIG. 4; 5/86.1, 5/81.1 RP, 81.1 HS, 83.1, 81.1 R
See application file for complete search history.

(56) References Cited

U.S. PATENT DOCUMENTS

| | | | | | |
|---|---|---|---|---|---|
| 3,061,365 | A * | 10/1962 | Frieberg | 297/39 |
| 3,215,469 | A * | 11/1965 | Wamsley | 297/344.18 |
| 4,193,147 | A * | 3/1980 | Fischer | 5/87.1 |
| 4,415,177 | A * | 11/1983 | Hale et al. | 280/650 |
| 4,963,762 | A * | 10/1990 | Brooks | 297/183.4 |
| 5,112,076 | A * | 5/1992 | Wilson | 280/657 |
| 5,601,302 | A * | 2/1997 | Beard et al. | 280/250.1 |
| 5,664,266 | A * | 9/1997 | Williams et al. | 5/86.1 |
| 5,884,929 | A * | 3/1999 | Kincaid | 280/304.1 |
| 6,381,781 | B1 * | 5/2002 | Bourgraf et al. | 5/618 |
| 6,648,343 | B2 * | 11/2003 | Way et al. | 280/5.22 |
| 6,736,417 | B1 * | 5/2004 | Whitmire | 280/47.3 |
| 6,793,232 | B1 * | 9/2004 | Wing | 280/304.1 |
| 7,500,689 | B2 * | 3/2009 | Pasternak et al. | 280/304.1 |
| 7,607,725 | B2 * | 10/2009 | Dickie et al. | 297/45 |
| 7,950,673 | B2 * | 5/2011 | Reed et al. | 280/5.22 |
| 8,066,301 | B1 * | 11/2011 | Westermann | 280/657 |
| 8,307,473 | B1 * | 11/2012 | Lambarth et al. | 5/81.1 R |
| 8,459,660 | B2 * | 6/2013 | Livingston | 280/5.22 |
| 2004/0206555 | A1 * | 10/2004 | Schneider | 180/9.32 |
| 2011/0304186 | A1 * | 12/2011 | Andrews | 297/344.16 |

* cited by examiner

*Primary Examiner* — John Walters
*Assistant Examiner* — Brian Swenson
(74) *Attorney, Agent, or Firm* — Hulsey Calhou, PC; William N. Hulsey

(57) ABSTRACT

The apparatus of the present disclosure is an improvement on known wheelchairs and other known devices for transporting elderly, infirm, injured, handicapped, disabled, or otherwise mobility-impaired individuals. The present disclosure provides a seat that is adjustable in height, tilt angle, and orientation, relative to the supporting surface and frame of the apparatus. In some embodiments, the height adjustment is provided via a hydraulic lift cart.

15 Claims, 11 Drawing Sheets

PERSON TRANSPORTING APPARATUS AND METHOD

FIELD OF THE INVENTION

This disclosure relates generally to the field of devices designed for use by elderly, infirm, injured, handicapped, disabled, or otherwise mobility-impaired individuals. More specifically, the present disclosure relates to individuals who may have trouble moving autonomously, including moving between a wheelchair-like device and a second location.

BACKGROUND OF THE INVENTION

It is a known problem that elderly, infirm, injured, handicapped, disabled, or otherwise mobility-impaired individuals often have trouble moving or being transported from one place to another. Such people will generally be referred to within this disclosure as "patients," but this term should be understood to include any individual as described above and anyone who may have need of a device to assist in moving from one place to another. Standard wheelchairs have been used for many years to accomplish this, but they have several deficiencies addressed by the present disclosure.

Standard wheelchairs generally have only a single, non-adjustable height. This lack of adjustability may make it difficult to move patients between the wheelchair and a second location, such as a bed, toilet, car seat, or any other place having a disparate height or that is difficult to reach with a standard wheelchair.

In addition to standard wheelchairs, other types of transporting apparatuses known in the art also have deficiencies addressed by the present disclosure.

One known apparatus uses a canvas sling that is placed under the patient and then hoisted from above. This device tends to take more than one assistant to operate and be uncomfortable for the patient. As the canvas is lifted from the corners, it tightens around the patient and can cause pain. It has been known even to cause bone problems, for example, in patients with osteoporosis. This type of apparatus may also lead to dropping the patient out of the canvas sling, causing further injury.

These and other limitations are present in known prior art devices having to do with the subject matter of the present disclosure.

BRIEF SUMMARY OF THE INVENTION

Therefore, a need has arisen for a way to transport elderly, infirm, injured, handicapped, disabled, or otherwise mobility-impaired individuals, hereafter patient, which allows them to move easily between destinations having disparate heights. It is an object of the present disclosure to provide such an apparatus. The apparatus of the present disclosure is small, foldable, easily transported, and capable of being steered and directed by a single person located behind or in front of the apparatus, hereafter orderly.

An exemplary embodiment of the present disclosure has: a seat that is both adjustable in height relative to the ground and is adjustable in orientation relative to the supporting frame; is provided with handles connected to both the front and back of the apparatus; and is able to be collapsed upon itself to enable convenient storage of the apparatus; and is provided with wheels to the base of the apparatus, such that a seated patient can be conveniently transferred using the apparatus.

A further embodiment of the present disclosure provides a slippery pad, which enables convenient sliding of the patient from the apparatus to a secondary seated position.

A further embodiment of the present disclosure allows the seating platform to slide back and forward relative to the supporting base plate.

In some embodiments, the present disclosure accomplishes the height adjustment of the seat through the use of a hydraulic lift cart. In other embodiments, this height adjustment is provided by the application of external work applied by a seated patient or an orderly. Other types of lifting mechanisms may also be used, including pneumatic actuators for example.

A technical advantage of the disclosed devices is that patients are able to be moved between many different places, including but not limited to beds, toilets, cars, trucks, standard wheelchairs, etc. The device is relatively inexpensive, lighter, simpler configuration and function, and enables orderlies to transport patient up and down steps. The devices of the present disclosure may be used to particular advantage in hospitals, retirement homes or for personal use in private homes.

These and other advantages of the disclosed subject matter, as well as additional novel features, will be apparent from the description provided herein. The intent of this summary is not to be a comprehensive description of the subject matter, but rather to provide a short overview of some of the subject matter's functionality. Other systems, methods, features and advantages here provided will become apparent to one with skill in the art upon examination of the following FIGURES and detailed description. It is intended that all such additional systems, methods, features and advantages included within this description, be within the scope of the claims.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF ILLUSTRATIVE EMBODIMENTS

Reference now should be made to the drawings, in which the same reference numbers are used throughout the different figures to designate the same components.

Figure 1:
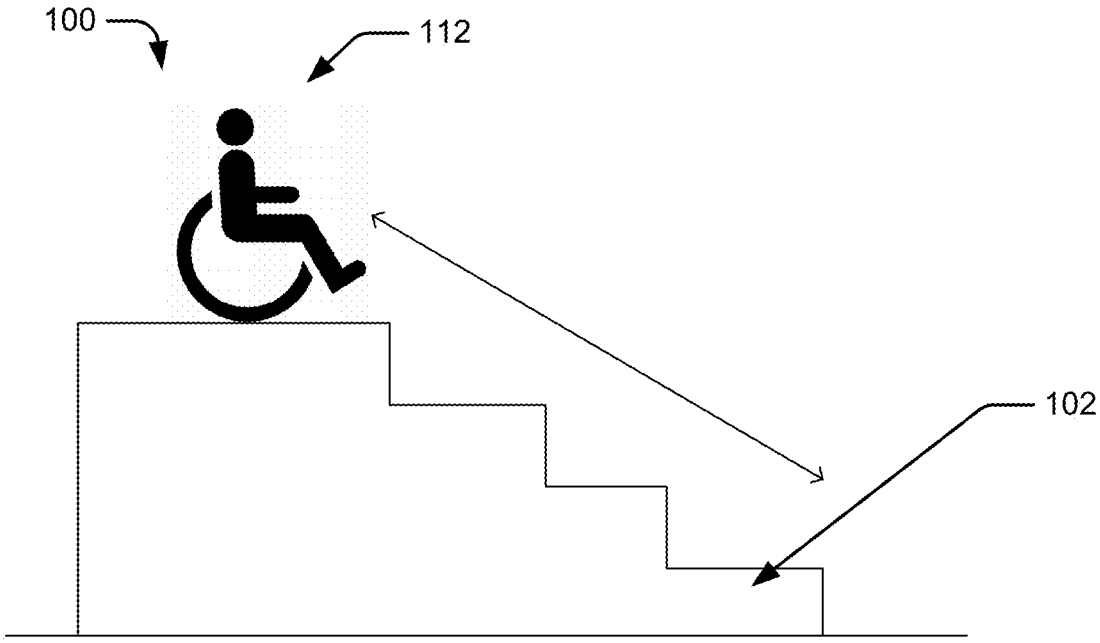
FIG. 1 illustrates some of the limitations of the existing technology with regards to the use of wheelchair like devices to transfer the mobility impaired users across a surface with a disparate level, i.e. stairs.

FIG. 1 demonstrates the existing shortcomings of the existing technology that embodiments of the present disclosure are able to overcome. Principally, the restrictions on travel paths with changes in level, as well as the inconvenience and difficulty of transferring a user or patient from a mobility device to a vehicle seat, in which the two seats have opposing alignments and/or are at differing heights.

Figure 2:
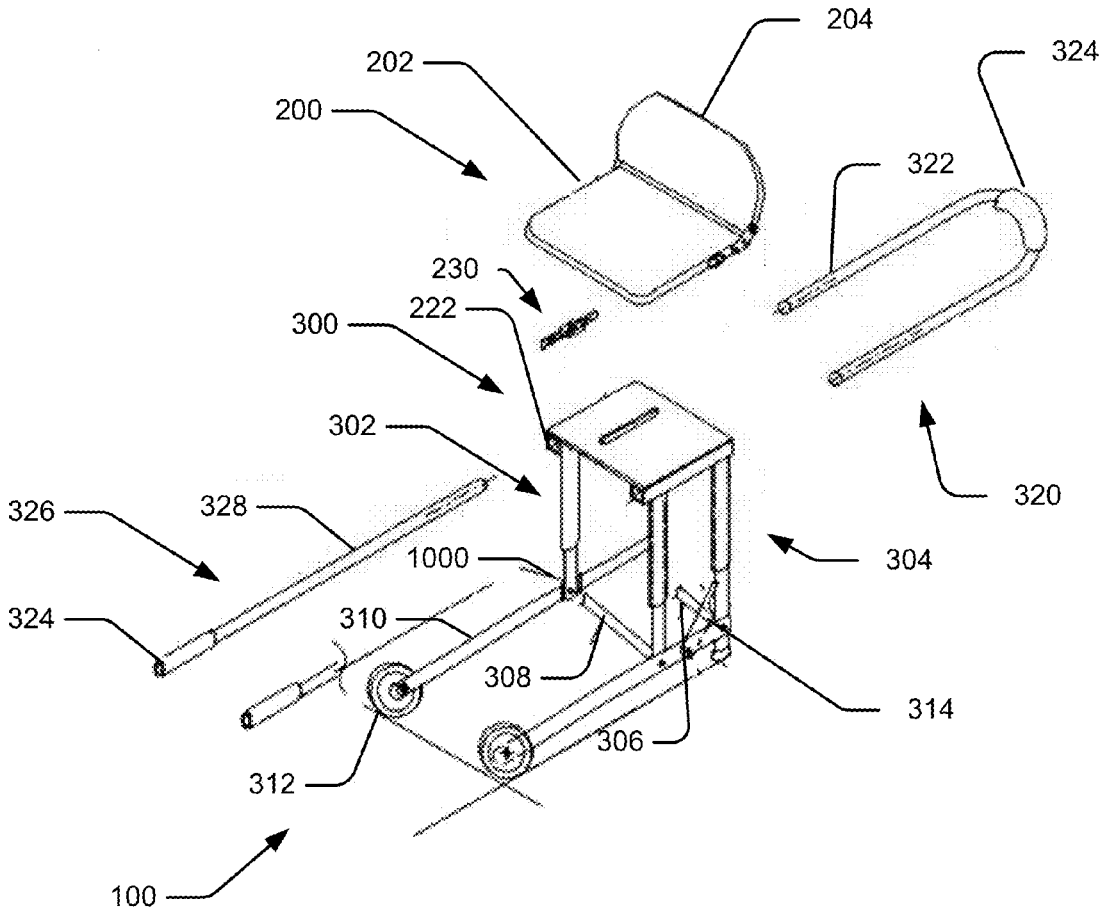
FIG. 2 schematically illustrates an exemplary embodiment of the present disclosure.

FIG. 2 illustrates a mobility impaired transfer apparatus. The exemplary apparatus includes the pivotable seat assembly 200, a supporting frame 300, front 326 and rear handles 328, and wheels 314. The pivotal seat assembly comprises a seat 202, a seat back 204. The frame comprises four essentially vertical members, including two front members 302, and two rear members 304. The frame additionally comprises a front 308 and rear 306 bracing member. In the exemplary apparatus shown, the wheels are separated and connected from/to the frame of the apparatus by the wheel leg 310. The exemplary apparatus shown provides two types of handles. The handles connected to the front of the apparatus include two bar handles, which comprise a pole 328 and handle grip 324. The handle connected at the back of the apparatus is u-shaped, comprising a u-shaped bar 322 and a handle grip 324. The apparatus can additionally comprise at least one upright lock 314, to prevent the apparatus from folding whilst in operation. In one embodiment, the apparatus' handles are independently removable.

In one embodiment, the apparatus transient mobility is provided by the application of external work, provided by a secondary user. In a hospital environment, this would typically encompass the role of an orderly, although there are no restrictions on the limitations of the secondary user. The term orderly is intended to encompass a secondary user 114 who is aiding or responsible for the transfer of the patient.

In the exemplary embodiment shown in FIG. 2, the apparatus is moved directionally by the application of external work provided via an orderly, who is positioned behind the apparatus and who applies work through the U-Bar handle. In other embodiments, external work can be provided by a variety of mechanisms, included but not limited to: by the patient seated on the apparatus; an engine fastened to the apparatus; one or more orderlies.

The exemplary embodiment presented in FIG. 2, additionally allows the motion of the apparatus to be halted simply by lowering the rear of the frame, such that the rear legs are in contact with the supporting surface. Other embodiment with additional wheels wherein the patient is able to operate the apparatus without the assistance of an orderly may include a breaking mechanism.

Figure 3:
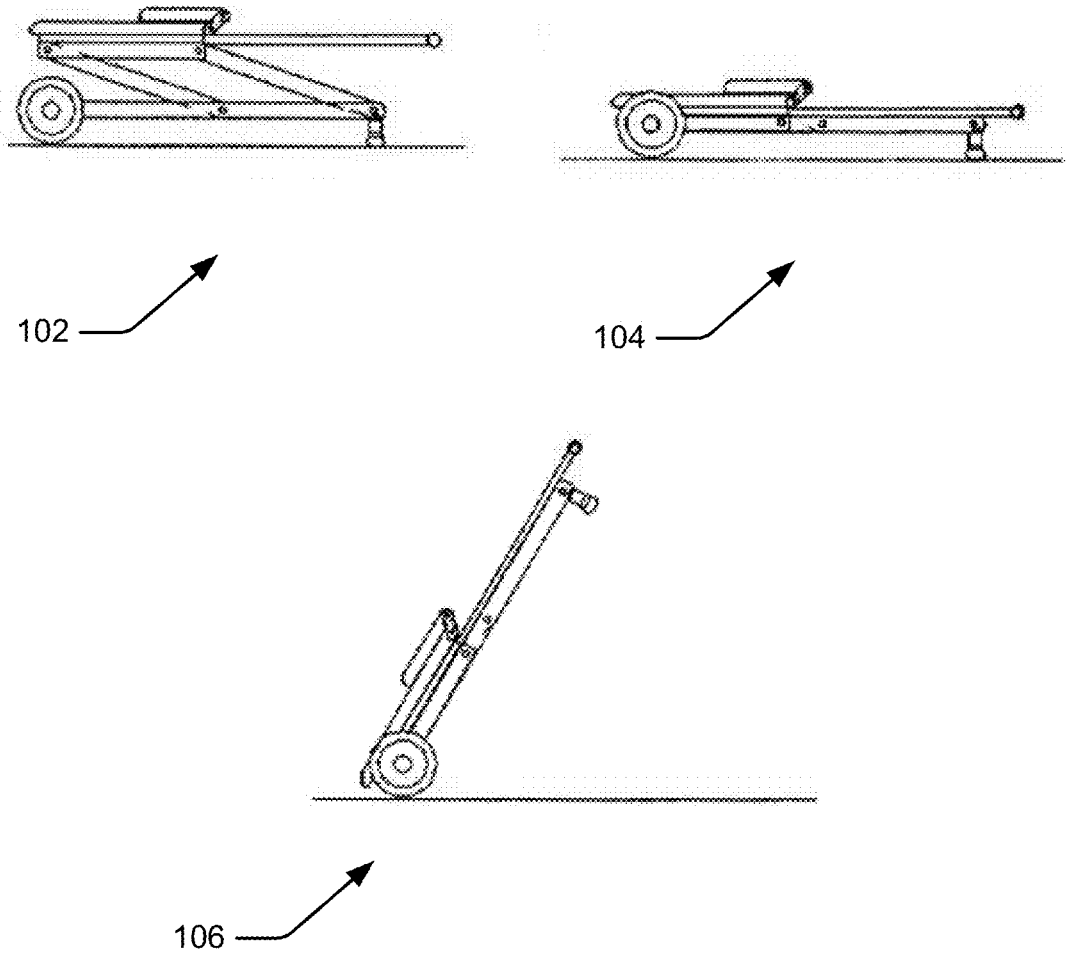
FIG. 3 schematically illustrates an exemplary embodiment of the present disclosure's collapsible positions.

FIG. 3 illustrates the collapsible positions of the present disclosure. The apparatus in its open state 100 is able to support a patient. Whereupon the patient has been transferred from the apparatus, the apparatus is collapsed, shown partially in 102, and fully collapsed 104, wherein the u-bar handle and bar handles are stored within the device. After the device is fully collapsed, the apparatus is raised 106 and is able to be moved and stored conveniently.

Figure 4:
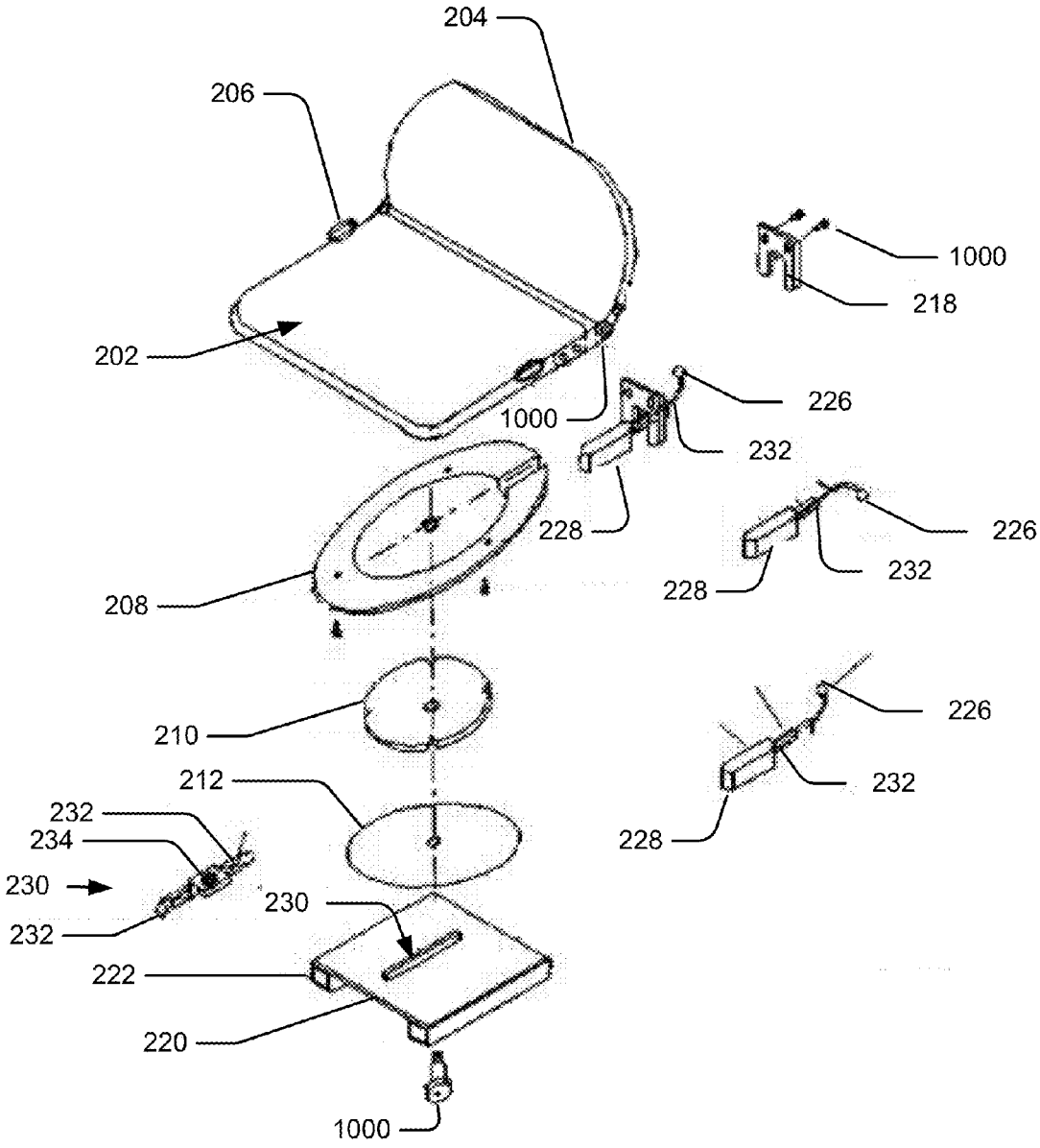
FIG. 4 schematically illustrates an exemplary embodiment of the present disclosure's pivotal seat assembly.

FIG. 4 illustrates the components of an exemplary pivotable seat assembly. An improvement of the disclosure over the existing technology is the ability of the seat platform 202 to rotate relative to the supporting frame of the apparatus. This enables improved ease of transfer of the mobility impaired from the apparatus to a secondary seated position such as a passenger car seat. The exemplary embodiment of a pivotal seat assembly comprises a seat platform coupled to a seat back 204. The fastening of the seat and the seat back is through a flexible joint, which enables the tilt of the seat back to be adjusted. The seating platform 202 is able to rotate relative to the base plate 220. The base plate includes square tubes, which are able to accommodate the front and rear handles. The present disclosure includes handles and their accommodation within the base frame that are a variety of shapes, cross sectional areas, etc. The pivotable seat assembly may additionally comprise a spring mechanism 230 fastened to the base frame and the seating platform that allows the seating platform to slide forwards or backwards relative to the base plate.

Figure 5:
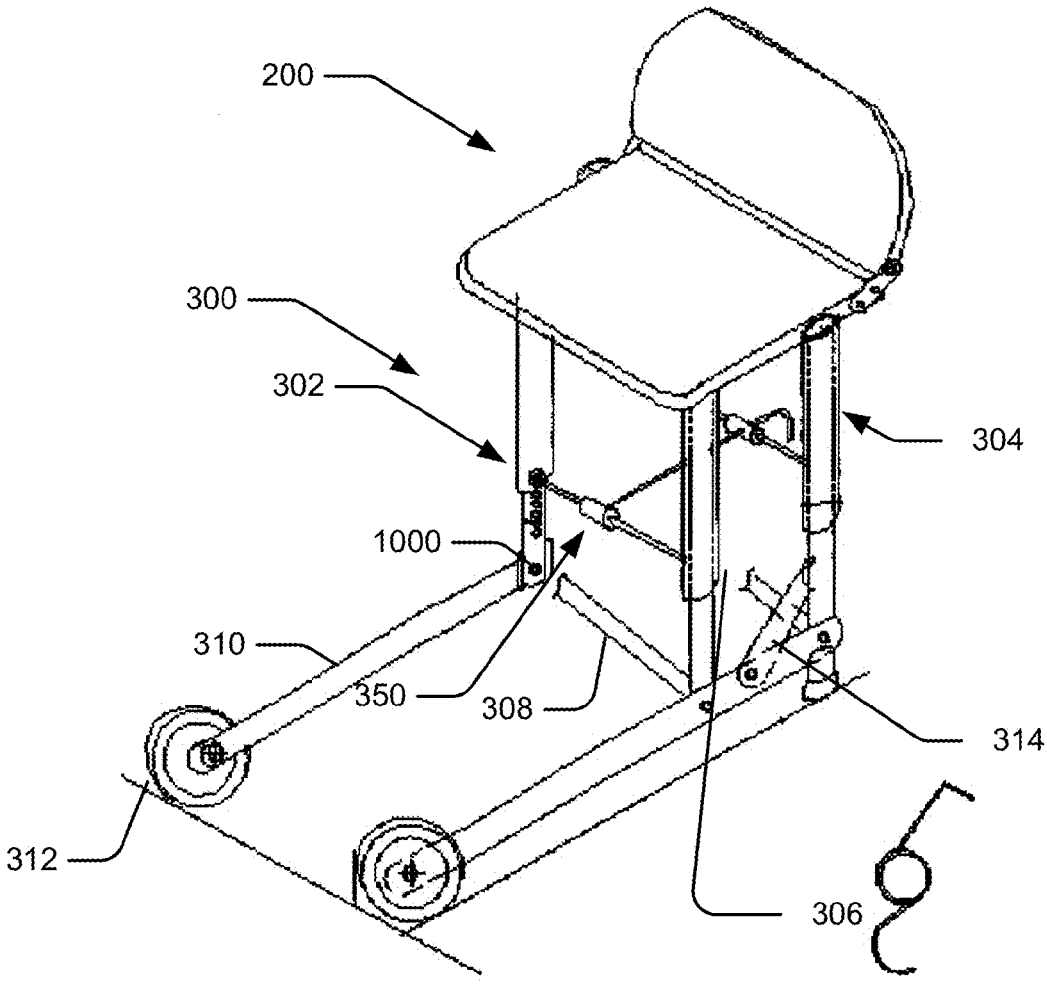
FIG. 5 schematically illustrates an exemplary embodiment of the present disclosure with the additional feature of a mechanical locking mechanism.

FIG. 5 shows the apparatus 100, an exemplary embodiment of the present disclosure, with the addition of a mechanical locking mechanism 350. In this embodiment, the raising and lowering of the seating platform relative to the transient surface is achieved through the application of external work by an orderly. The pivotal seat assembly can be raised and lowered relative to the transient surface both when the apparatus is occupied and unoccupied.

Figure 6:
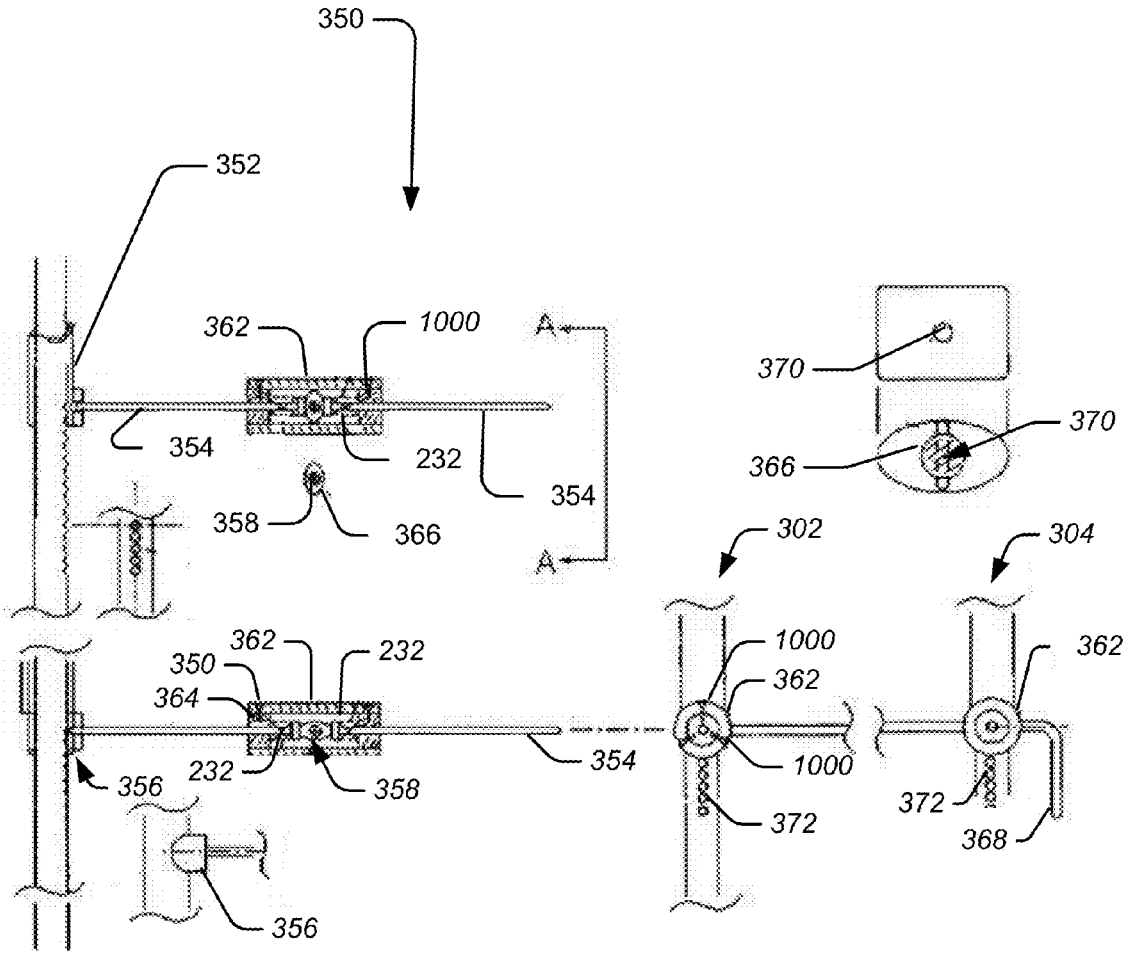
FIG. 6 schematically illustrates an exemplary mechanical locking mechanism in greater detail.

FIG. 6 shows an exemplary mechanical locking mechanism 350, wherein the vertical members are connected telescopically, such that a portion of the upper leg segment is able to accommodate a varying portion of the lower leg. The embodiment presented in FIG. 6 further illustrates an exemplary mechanical locking mechanism by which the telescopic vertical members may be fixed at a uniform length, or a uniform setting, such that the seating surface is at its operable inclination. In this embodiment, each lower leg segment of the telescopic legs is provided with apertures 372, or voids, spaced equidistance along the portion that is able to accommodated, and each upper leg segment includes a single button spring 356. Furthermore, the locking mechanism comprises a bullet nose shaft 354 that slides into the upper leg segment and the corresponding aperture located on the overlapping portion of the lower leg segment. The sliding of the bullet nose shaft to/from the upper leg and lower leg segment controls the freedom of telescopic movement, and hence the height of the seating platform. In this embodiment, each bullet nose shaft 354 is further connected to a housing unit 362, of which the present embodiment includes two. The housing unit comprises a portion of two bullet nose shafts, two springs 232 each of which are connected to the housing unit and one of the bullet nose shafts, as well as a taper pin 358. The taper pin 358 is able to rotate between a vertical and horizontal orientation, whereby in its horizontal position; a reduced portion of the bullet nose shaft is accommodated in the housing, and in the vertical position; an increased portion of the bullet nose shaft is accommodated in the housing. A reduced portion of the bullet nose shaft corresponds to the bullet nose shaft fitting into an appropriate aperture positioned on the lower leg segment, and hence no freedom of telescopic movement. Likewise, an increased portion of bullet nose shaft accommodated in the housing unit corresponds to a freedom of telescopic movement.

Figure 7:
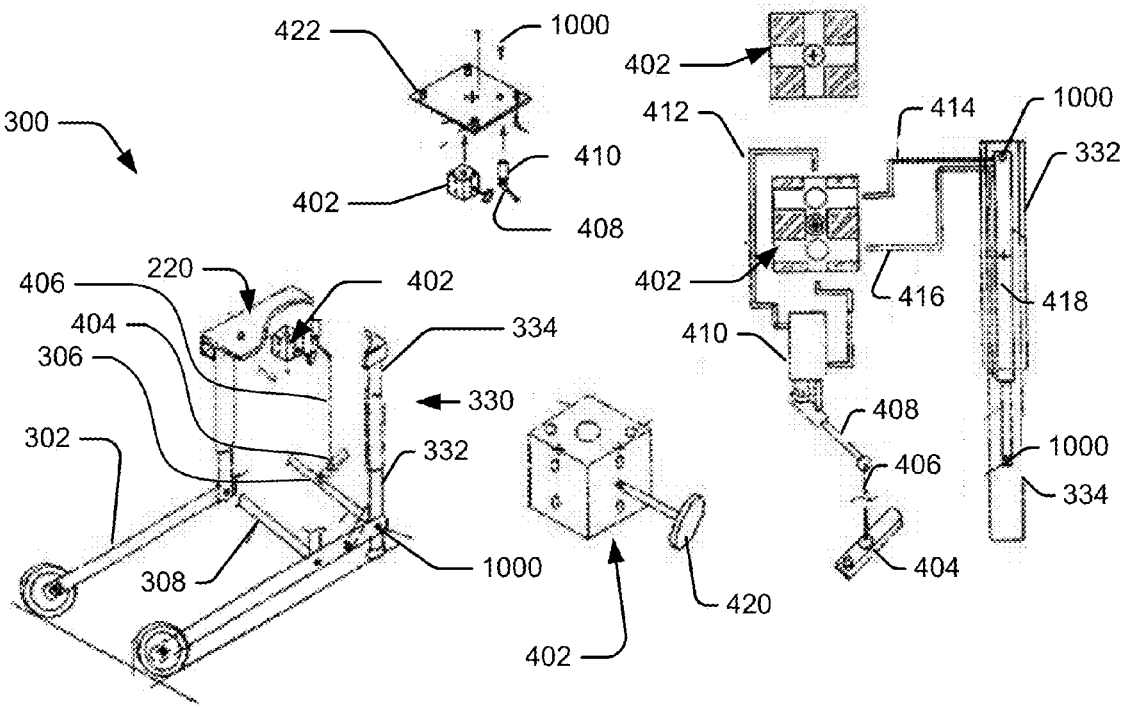
FIG. 7 schematically illustrates an exemplary embodiment of the present disclosure with the additional feature of a hydraulic lifting mechanism.

FIG. 7 shows the apparatus 100, an exemplary embodiment of the present disclosure, with the addition of a hydraulic lift. The hydraulic lift is actuated by hydraulic handle 408, which operates the hydraulic pump 408, and forces fluid along the feeder tube(s) causing the rod within the hydraulic cylinder 418 to expand, which in turn increases the length of the leg(s), and raises the height of the seating platform relative to the supporting surface. In the exemplary embodiment shown, the hydraulic handle is connected to a foot treadle 404 via a link rod, which enables foot activation of the hydraulic pump. Pressure in the hydraulic cylinder may be released by activating the valve 420, which allows fluid to be returned via the return tube(s) 416, which in turn lowers the height of the seating platform.

Figure 8:
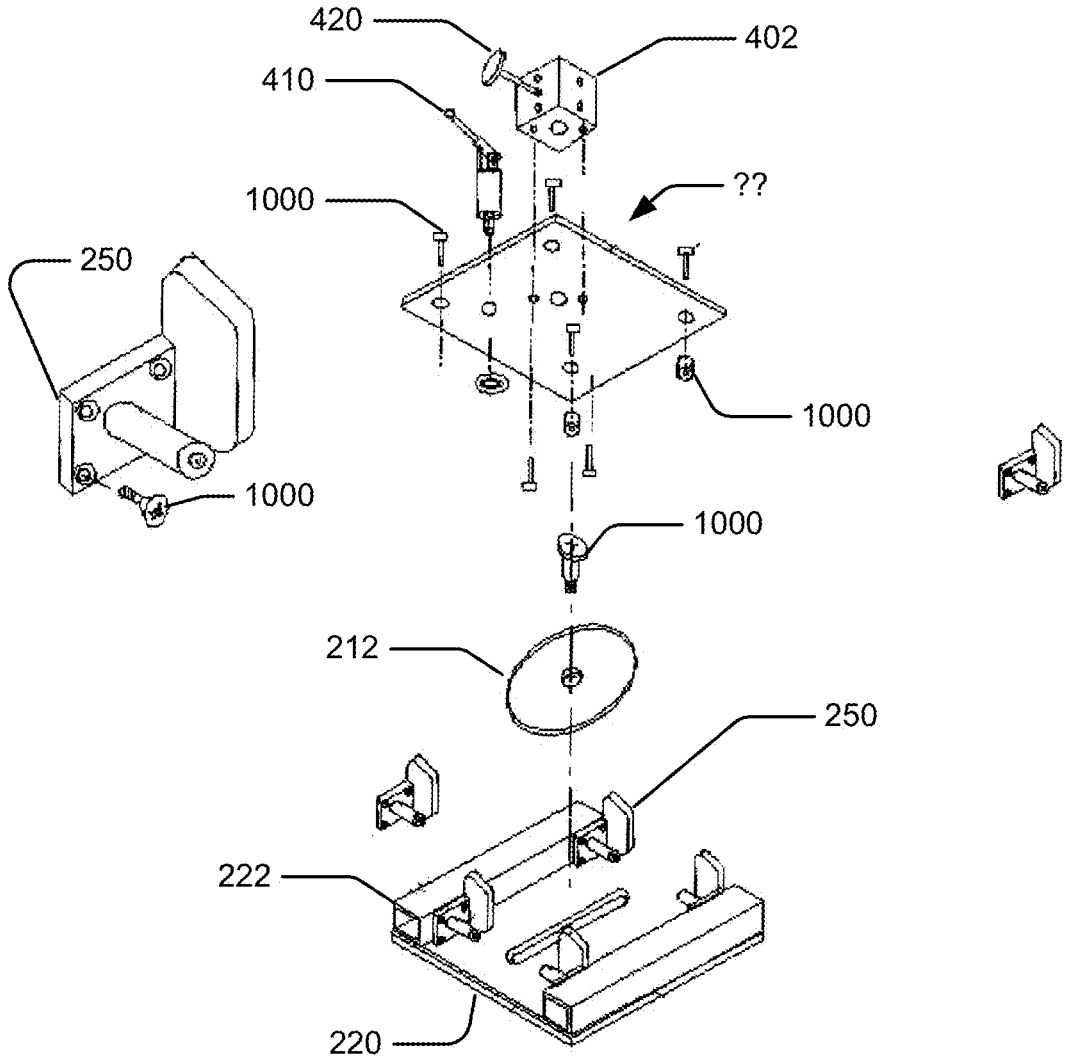
FIG. 8 schematically illustrates an exemplary hydraulic lifting mechanism in greater detail from the under-side perspective.

FIG. 8 shows an exemplary hydraulic lift mechanism and an exemplary coupling of the system to the base plate of the pivotal seat assembly. Including the fastening of the hydraulic system to the base plate. The figure further present an exemplary method of fastening the legs to the base plate using EAR 250 flexible joints, which enable the system to collapse in the intended fashion whilst preventing the apparatus folding backwards.

The present disclosure also provides a method for traversing a difference in level. A patient 112 seated within the apparatus 100 can be moved by two orderlies 114, whereupon approaching a difference in level, the two orderlies apply vertical force to each of the forward handles 308 and the rear handle 310 to raise the apparatus relative to the level of the supporting surface.

The exemplary embodiment shown includes two wheels 312, which are located forward of the apparatus' frame 300 and by the wheel legs. Other embodiments of the present disclosure include apparatus with additional, or fewer wheels, with varying wheel fixture locations.

An additional feature of the present disclosure includes: a seat belt, or restraining mechanism, coupled to the frame or pivotable seat assembly, which prevents the patient from unintentionally exiting the apparatus.

Figure 9:
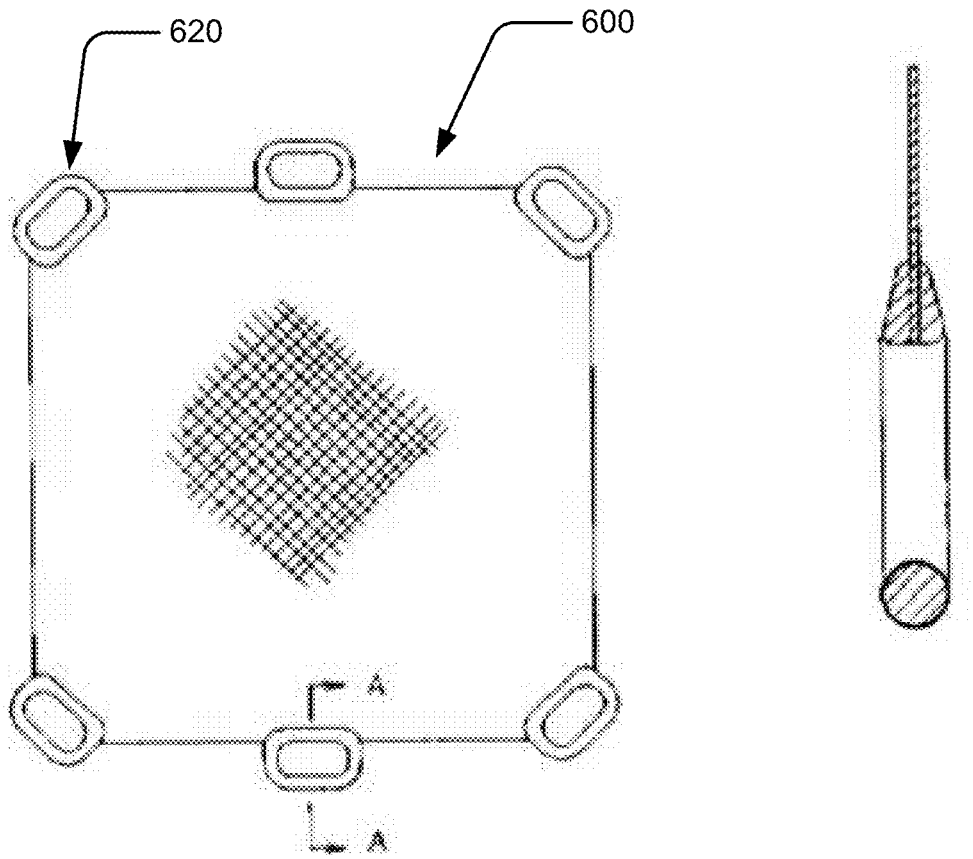
FIG. 9 illustrates an exemplary feature of the disclosure to add in the transfer of the patient from one seated position to another.

A further additional feature of the present disclosure is presented in FIG. 9, which is a method to assist an orderly in transferring the seated patient from the seating platform to a secondary position. This method comprises the use of a slippery pad 600 which is positioned on the seating platform of the apparatus prior to the patient being seated. The orderly is able to utilize the slippery pad to slide the patient from the apparatus to the secondary seated position, wherein the patient stays seated on the slippery pad, and wherein the secondary seated position is of a comparable height and orientation relative to the seating platform of the apparatus. The slippery pad can additional include handles along the edges, and/or corners to improve the ease of transferring the patient. In other embodiments of the present disclosure, the slippery pad could be replaced by a fabric or other material covering, which is able to be placed, and easily slid over the surface of the apparatus' and the secondary seating's positions.

Figure 10:
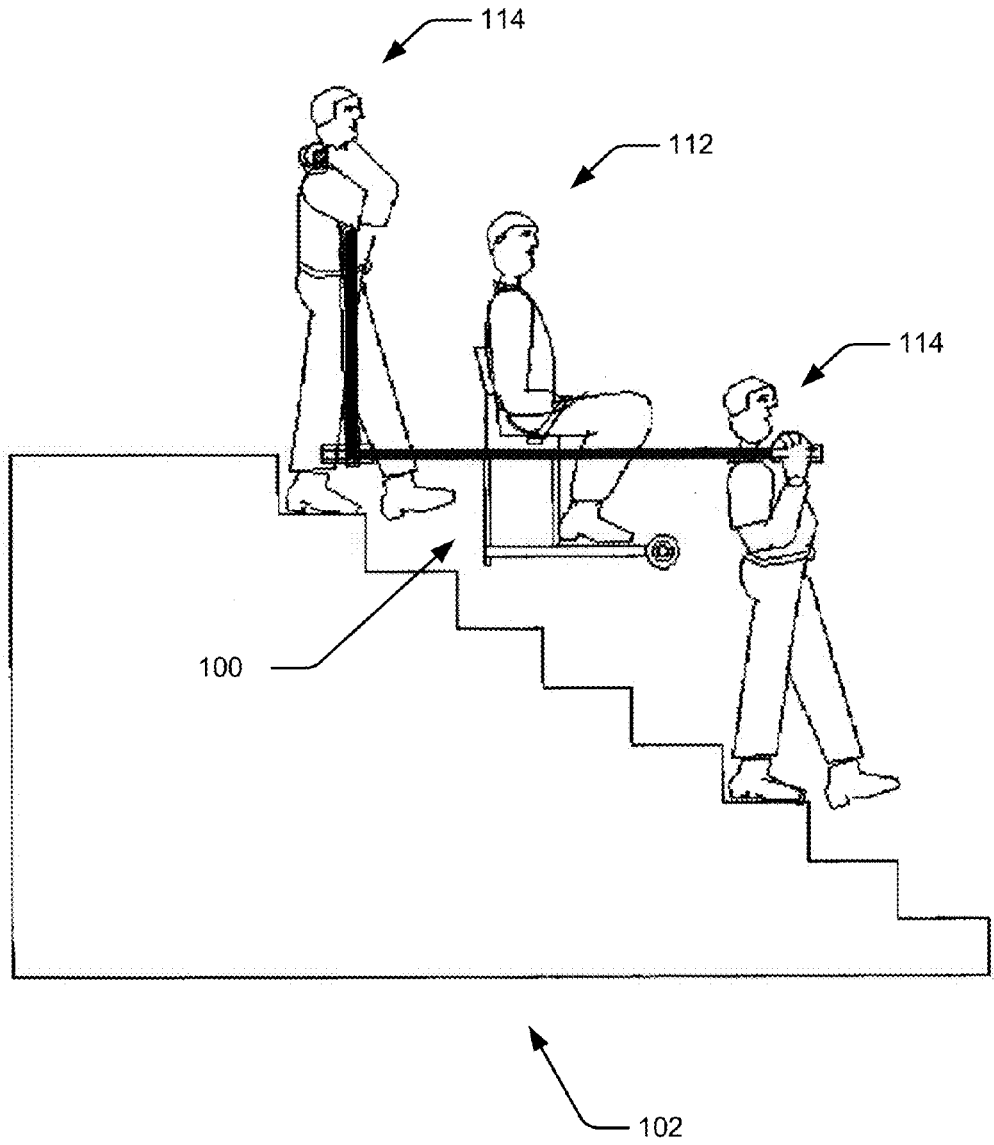
FIG. 10 illustrates an exemplary method by which the apparatus can be transported.

FIG. 10 presents an exemplary embodiment of the device, wherein the device has a seated patient 112 and is carried by two orderlies 112 situated at the front and rear of the apparatus. In this exemplary embodiment, the apparatus is additional fitted with lifting straps, which connect to the rear handles, and enable the rear orderly to apply force to the handles in circumstances which would otherwise be inconvenient, i.e. due to a difference in height between the two orderlies, the topmost orderly would need to hunch or stoop in order to be able to hold onto the handles. Other embodiments of the present disclosure may have straps fitted to either or both, the front or rear handles of the apparatus, to enable steps to be ascended or descended.

Figure 11:
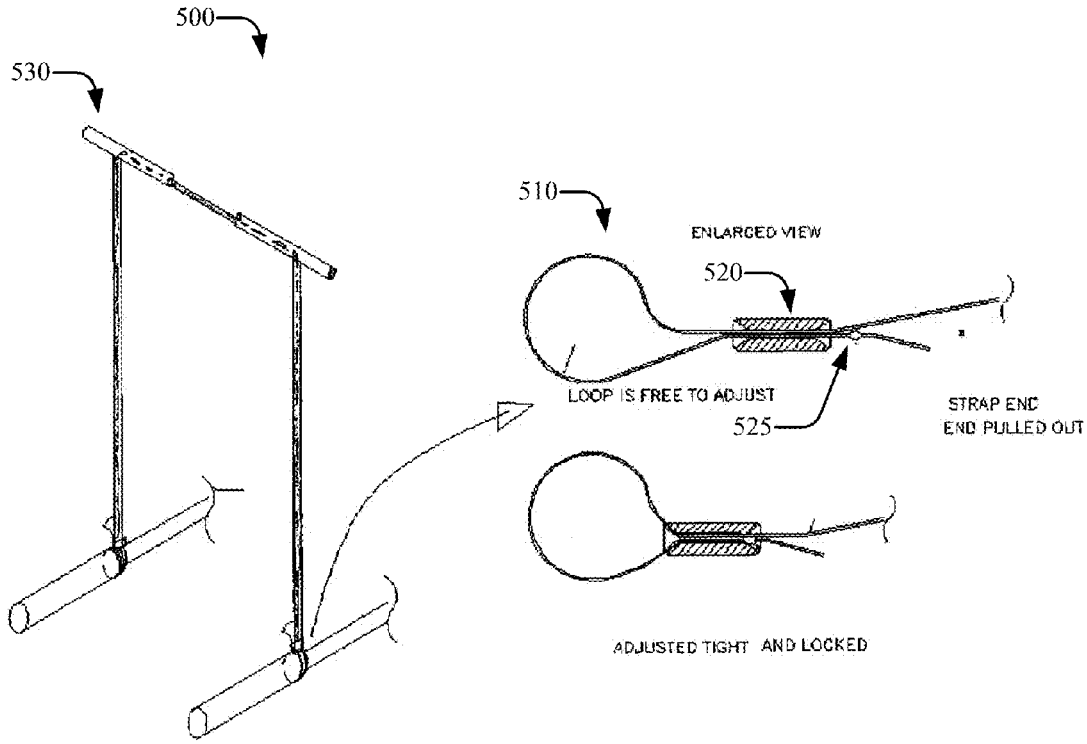
FIG. 11 illustrates in greater detail exemplary fittings that could be used to aid in the transport of the apparatus.

FIG. 11 schematically presents an exemplary lifting strap mechanism, comprising cords which connect to each of the rear handles 510, a mechanism 520 for locking the strap loop to the handles, and a bar 530 for fitting to the orderly. Other embodiments of the present disclosure can include a variety of methods for fitting to the orderly. It is noted that some embodiments the lifting straps may require a skilled orderly or someone who is familiar in their use.

In one embodiment, the strap loop can be fixed by the use of a knot or bead locking mechanism that is able to slide into the housing mechanism, whereby the aperture formed by the looping of the cord or strap is fixed.

In a further embodiment, the weight of the front and rear handles, as well as other components of the apparatus, can be minimized by the use of circular, rectangular, or other cross sectional hollow tubes.

The embodiments shown in the present disclosure, include apparatus constructed using plastic, composite, metal, and fabric materials. Furthermore, the term fasteners 1000 has been used to indicate an exemplary location and form of connection, wherein these fasteners may include but not are limited to: hinge joints, shoulder screw, springs, lock nut, clevis pin, and other forms of fastening as known in the art.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable sub-combination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described hereinabove. Rather the scope of the present invention is defined by the appended claims and includes both combinations and sub-combinations of the various features described hereinabove as well as variations and modifications thereof, which would occur to persons skilled in the art upon reading the foregoing description.

DEFINITION OF TERMS

100 Apparatus
102 semi folded
104 folded
106 carried
110 Stairs
112 patient

114 orderly
120 Apparatus with Hydraulics
130 Apparatus without Hydraulics
200 Pivotal Seat Assembly
202 Seat
204 Seat Back
206 Seat Belt Loop
208 Top Plate
210 Index Plate
212 Low Friction Washer
218 Retainer Plate
220 Base Plate
222 Square Tube
226 Knob
228 Index Finger
230 XX Fixture
232 Spring
234 T-Bushing
250 EAR
300 Frame
302 front legs
304 rear legs
306 rear tie rod
308 front tie rod
310 wheel leg
312 wheel
314 upright position lock
320 u-bar
322 bar
324 grip/handle
326 bar handle
328 pole
330 Leg (front/back)
332 lower leg
334 Upper Leg
350 Locking Mechanism
352 collar
354 bullet nosed shaft
356 cap
358 cam
362 housing
364 bushing
366 cam shaft
368 cam shaft handle
370 taperpin
372 height adjusting holes
400 Hydraulics
402 Hyd. Distribution Box (included
404 foot treadle
406 link rod
408 Hyd. Pump Handle
410 Hydraulic Pump
412 by-pass tube
414 feeder tube (four of equal length)
416 return tube (four of equal length)
418 hydraulic cylinder
420 Bleed Valve
422 stand off
500 Lifting straps
600 Sliding Pad
510 Strap Loop
520 Locking mechanism
525 Bead
530 Bar
620 Handle
1000 Fastener

What is claimed is:

1. An apparatus for assisting the moving of individuals with mobility difficulties, the apparatus comprising:

a supporting frame structure, wherein said supporting frame structure transfers weight of patient to supporting surface, and wherein said supporting frame structure comprises:

at least one telescopic vertical member, wherein said telescopic vertical member transfers patient's weight to supporting surface; and at least one bracing member coupled to said telescopic vertical member, wherein said bracing member enables rigidity of said frame structure by the transfer of forces between said at least one telescopic vertical member, a pivotal seat assembly, said pivotal seat assembly comprising:

a base plate coupled to supporting frame, whereby changes in length of said telescopic vertical member causes a corresponding change in height of said base plate relative to the supporting surface, wherein said base plate has a plurality of fixable heights relative to the supporting surface;

a seat platform coupled to said base plate by a pivot joint, wherein said platform:

rotates through a defined range relative to said base plate;

supports the weight of the patient by permitting the transfer of force through said base plate to said at least one vertical member, a seat back flexibly coupled to said seating platform, wherein angle between said seat back and seat platform has a defined range, a plurality of wheels connected to said supporting frame, wherein said wheels permit transient movement of said apparatus across the supporting surface;

a rear handle removably coupled to said frame, wherein said rear handle is a u-bar handle;

at least one forward handle removably coupled to said frame, wherein said at least one front handle is a bar handle;

a hydraulic cylinder accommodated within said at least one telescopic vertical member;

a hydraulic system for controlling the height of the base plate relative to the supporting surface, wherein said hydraulic system comprises:

a hydraulic pump;

at least one feeder tube connected to said hydraulic pump and said hydraulic cylinder located in at least one telescopic vertical member, wherein said at least one feeder tube accommodates the flow of pressurized fluid from said hydraulic pump to said hydraulic cylinder;

a hydraulic pump handle connected to said hydraulic pump, wherein actuation of said hydraulic pump actuates the flow of pressurized fluid into said hydraulic cylinder; whereby said at least one telescopic vertical members extend in length, a bleed valve coupled to said return tube, said valve having a release, and a non-release stage;

a return tube connected to said hydraulic cylinder and said hydraulic pump, wherein activation of said release stage of said valve permit the outflow of fluid from hydraulic cylinder, whereby said at least one telescopic vertical member reduces in length.

2. The apparatus in claim 1, wherein said front handles and said rear handles are independently removable.

3. The apparatus in claim 2, wherein the coupling of: said pivotal seat assembly to said supporting frame structure; said at least one telescopic vertical member to said at least one bracing member; permit the rotation of the respective elements, whereby the apparatus is collapsible.

4. The apparatus in claim 3, whereupon said collapse of apparatus:

base plate aligns parallel to supporting surface thus presenting coupling locations of said at least one forward handle and rear handle, contained within said base plate, whereby enabling convenient reinsertion of said at least one forward handle and said rear handle.

5. The apparatus in claim 1, wherein said pivot joint coupling said seating platform to said base plate, additionally comprises a sliding mechanisms, whereby said seating platform slides and rotates relative to said base plate.

6. The apparatus in claim 1, wherein said hydraulic system additionally comprises:

a link rod connected to said hydraulic pump handle;

a foot treadle connected to said link rod, wherein actuation of said foot treadle causes a resultant actuation of said hydraulic pump handle.

7. The apparatus in claim 1, wherein the apparatus additionally comprises:

an upper leg segment and a lower leg segment as part of said telescopic vertical member, wherein said upper leg segment and said lower leg segment are telescopic connected, whereby said upper leg segment accommodates a variable portion of said lower leg segment, wherein said lower leg segment include apertures at spaced equidistant intervals;

a mechanical locking mechanism, whereby said mechanical locking mechanism simultaneous actuates the change of said portion of lower leg segment accommodated by said portion of upper leg segment.

8. The apparatus in claim 1, wherein said at least one forward handle and said rear handle transmit vertical force to said supporting frame structure, whereby the application of sufficient vertical force to said at least one forward handle and said rear handle raises the height.

9. The apparatus in claim 1, wherein said at least one bracing member is the pivotal seat assembly.

10. The apparatus in claim 1, wherein said apparatus additionally comprises a transient fabric surface placed on said seating platform, wherein said fabric surface has sufficient tensile strength to support weight of patient, wherein said at least one surface of said fabric surface is slippery, whereby application of both a vertical force to at least one edge of fabric surface and a directional force to at least one edge of fabric surface enables patient to be slid from said seating platform of apparatus to a secondary seating position.

11. The apparatus in claim 1, wherein lifting straps are removably coupled to the apparatus thus providing a mechanism for the carrying of the apparatus.

12. An apparatus for assisting the moving of individuals with mobility difficulties, the apparatus comprising:

a supporting frame structure, wherein said supporting frame structure transfers weight of patient to supporting surface, and wherein said supporting frame structure comprises:

at least one telescopic vertical member, wherein said telescopic vertical member transfers patient's weight to supporting surface; and at least one bracing member coupled to said telescopic vertical member, wherein said bracing member enables rigidity of said frame structure by the transfer of forces between said at least one telescopic vertical member, a pivotal seat assembly, said pivotal seat assembly comprising:

a base plate coupled to supporting frame, whereby changes in length of said telescopic vertical member causes a corresponding change in height of said base plate relative to the supporting surface, wherein said base plate has a plurality of fixable heights relative to the supporting surface;

a seat platform coupled to said base plate by a pivot joint, wherein said platform:

rotates through a defined range relative to said base plate;

supports the weight of the patient by permitting the transfer of force through said base plate to said at least one vertical member, a seat back flexibly coupled to said seating platform, wherein angle between said seat back and seat platform has a defined range, a plurality of wheels connected to said supporting frame, wherein said wheels permit transient movement of said apparatus across the supporting surface;

a rear handle removably coupled to said frame, wherein said rear handle is a u-bar handle;

at least one forward handle removably coupled to said frame, wherein said at least one front handle is a bar handle;

wherein said front handles and said rear handles are independently removable;

wherein the coupling of: said pivotal seat assembly to said supporting frame structure; said at least one telescopic vertical member to said at least one bracing member; permit the rotation of the respective elements, whereby the apparatus is collapsible;

whereupon said collapse of apparatus:

base plate aligns parallel to supporting surface thus presenting coupling locations of said at least one forward handle and rear handle, contained within said base plate, whereby enabling convenient reinsertion of said at least one forward handle and said rear handle.

13. The apparatus in claim 12 additionally comprising:

a hydraulic cylinder accommodated within said at least one telescopic vertical member;

a hydraulic system for controlling the height of the base plate relative to the supporting surface, wherein said hydraulic system comprises:

a hydraulic pump;

at least one feeder tube connected to said hydraulic pump and said hydraulic cylinder located in at least one telescopic vertical member, wherein said at least one feeder tube accommodates the flow of pressurized fluid from said hydraulic pump to said hydraulic cylinder;

a hydraulic pump handle connected to said hydraulic pump, wherein actuation of said hydraulic pump actuates the flow of pressurized fluid into said hydraulic cylinder; whereby said at least one telescopic vertical members extend in length, a bleed valve coupled to said return tube, said valve having a release, and a non-release stage;

a return tube connected to said hydraulic cylinder and said hydraulic pump, wherein activation of said release stage of said valve permit the outflow of fluid from hydraulic cylinder, whereby said at least one telescopic vertical member reduces in length.

14. The apparatus in claim 13, wherein said hydraulic system additionally comprises:

a link rod connected to said hydraulic pump handle;

a foot treadle connected to said link rod, wherein actuation of said foot treadle causes a resultant actuation of said hydraulic pump handle.

15. The apparatus in claim 12, wherein the apparatus additionally comprises:

an upper leg segment and a lower leg segment as part of said telescopic vertical member, wherein said upper leg segment and said lower leg segment are telescopic connected, whereby said upper leg segment accommodates a variable portion of said lower leg segment, wherein said lower leg segment include apertures at spaced equidistant intervals;

a mechanical locking mechanism, whereby said mechanical locking mechanism simultaneous actuates the change of said portion of lower leg segment accommodated by said portion of upper leg segment.

* * * * *